US005270158A

United States Patent [19]

Nakatsugawa et al.

[11] Patent Number: 5,270,158

[45] Date of Patent: Dec. 14, 1993

[54] LIGHT-SENSITIVE SILVER HALIDE COLOR PHOTOGRAPHIC MATERIAL

[75] Inventors: Hiroshi Nakatsugawa; Takaaki Kojima, both of Odawara, Japan

[73] Assignee: Konica Corporation, Tokyo, Japan

[21] Appl. No.: 889,062

[22] Filed: May 26, 1992

[30] Foreign Application Priority Data

May 28, 1991 [JP] Japan ..... 3-123791

[51] Int. Cl.[5] ..... G03C 1/76

[52] U.S. Cl. ..... 430/523; 430/571; 430/509; 430/551; 430/546; 430/554; 430/555; 430/544; 430/510

[58] Field of Search ..... 430/523, 571, 509, 551, 430/546, 554, 555, 544, 510

[56] References Cited

U.S. PATENT DOCUMENTS

| | | | |
|---|---|---|---|
| 2,318,597 | 5/1943 | Davey et al. | 430/571 |
| 2,358,060 | 9/1944 | Davey | 430/571 |
| 4,310,623 | 1/1982 | Watanabe et al. | 430/546 |
| 4,438,194 | 3/1984 | Hamada | 430/509 |
| 4,640,890 | 2/1987 | Fujita et al. | 430/509 |
| 4,830,956 | 5/1989 | Waki | 430/558 |
| 4,954,431 | 9/1990 | Nishijima et al. | 430/551 |
| 5,110,718 | 5/1992 | Tanji et al. | 430/551 |

FOREIGN PATENT DOCUMENTS

| | | | |
|---|---|---|---|
| 0009528 | 1/1978 | Japan | 430/551 |
| 2194068 | 2/1988 | United Kingdom . | |

OTHER PUBLICATIONS

Patent Abstracts of Japan, vol. 13, No. 492 (p. 955) [3840]; Nov. 8, 1989 JPA-1-195446; Aug. 7, 1989.

*Primary Examiner*—Charles L. Bowers, Jr.
*Assistant Examiner*—Thomas R. Neville
*Attorney, Agent, or Firm*—Jordan B. Bierman

[57] ABSTRACT

A light-sensitive silver halide color photographic material is disclosed. The light-sensitive material comprises a support and a silver halide emulsion layer and a non-light-sensitive hydrophilic colloid layer provided on the support. The emulsion layer comprises a mixture of at least two kinds of silver halide emulsions which different from each other in sensitivity. The emulsion layer contains a magenta coupler represented by Formula II and the non-light-sensitive layer contains a compound represented by formula II:

(I)

wherein Ar is an aryl group; Y is a hydrogen atom or a substituent capable of releasing upon reaction with the oxidation product of a color developing agent; X is a halogen atom, an alkoxy group or an alkyl group; n is an integer of 0 to 4, Xs are the same or different when n is 2 or more; R is a strait chain or branched alkyl group having 1 to 20 carbon atoms, (II)

wherein $R_1$ and $R_2$ are each a secondary tertiary alkyl group, provided the total number of carbon atoms contained in $R_1$ and $R_2$ are 20 or more.

9 Claims, No Drawings

LIGHT-SENSITIVE SILVER HALIDE COLOR PHOTOGRAPHIC MATERIAL

FIELD OF THE INVENTION

This invention relates to a light-sensitive silver halide color photographic material. More particularly it relates to a light-sensitive silver halide color photographic material that can prevent color mixture from occurring in rapid processing and has a superior renderability.

BACKGROUND OF THE INVENTION

In recent years, in dye image forming methods making use of light-sensitive silver halide color photographic materials, it is common to carry out high-temperature photographic processing and save processing steps so that photographic processing can be completed in a shorter time. In particular, in order to shorten the photographic processing time in high-temperature rapid processing, it is very important to increase the rate of development in color development.

Light-sensitive silver halide color photographic materials having a silver halide emulsion layer containing silver halide grains substantially composed of silver chloride (hereinafter "silver chloride color photographic material(s)" are known to enable much more rapid processing than conventional silver chlorobromide color photographic materials. However, color photographic materials containing single-component silver halide grains substantially composed of silver chloride have a poor renderability in a shadow portion of image.

In order to solve this problem, Japanese Patent Publications Open to Public Inspection (hereinafter "Japanese Patent O.P.I. Publication(s)") No. 148049/1984, No. 718383/1985, No. 172348/1987 and No. 5234/1987 disclose use of a mixture of silver halide emulsions made different in grain size, crystal habit or composition of silver halide grains to have different sensitivities. However, in a magenta coupler represented by Formula I described later, there has been an undesirable problem of color mixture occurring when color development is carried out.

This color mixture is a phenomenon caused when an oxidized product of a color developing agent, produced as a result of color development, diffusingly moves to other silver halide emulsion layer during color photographic processing and couples with a coupler present in and for that layer to form color.

As a countermeasure to prevent this color mixture, a method is widely employed in which an intermediate layer to which a non-diffusible hydroquinone compound has been added is provided between silver halide emulsion layers and the oxidized product of a developing agent that has diffused is reduced and captured in the intermediate layer so that its coupling ability is lost.

Non-diffusible hydroquinone compounds usable for such purpose of preventing color mixture are disclosed in, for example, U.S. Pat. Nos. 2,336,327, 2,360,290, 2,384,658, 2,675,532, 2,728,659, 2,732,300 and 3,700,453 and Japanese Patent Examined publications No. 40818/1981 and No. 3404/1978.

In Japanese Patent O.P.I. publication No. 143544/1985, use of a hydroquinone compound having tertiary alkyl groups at the 2- and 5-positions and a hydroquinone compound having a secondary alkyl group at the 2-position is disclosed.

SUMMARY OF THE INVENTION

An object of the present invention is to provide a light-sensitive silver halide color photographic material having a good shadow renderability and improved fresh-color reproducibility and capable of preventing occurrence of color mixture, even in rapid processing.

The object of the present invention can be achieved by a light-sensitive silver halide color photographic material comprising a support having thereon a silver halide emulsion layer and a non-light-sensitive hydrophilic colloid layer, wherein the silver halide emulsion layer comprises a mixture of at least two kinds of silver halide emulsions different in sensitivity from each other and contains a magenta dye forming coupler represented by Formula I and the non-light-sensitive layer contains a compound represented by Formula II.

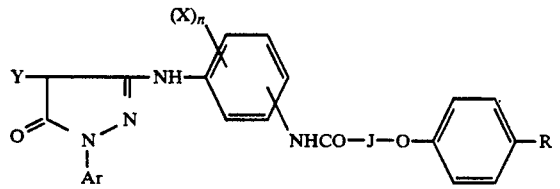

wherein Ar represents an aryl group; Y represents a hydrogen atom or a group capable of being split off upon reaction with an oxidized product of a color developing agent; X represents a halogen atom, an alkoxyl group or an alkyl group, n represents an integer of 0 to 4, and when n is two or more a plurality of X may be the same or different; R represents a straight-chain or branched alkyl group having 1 to 20 carbon atoms; and J represents straight-chain or branched alkylene group.

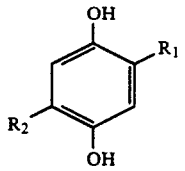

wherein $R_1$ and $R_2$ each represent a secondary or tertiary alkyl group, provided that the total sum of carbon atom number of the alkyl groups represented by $R_1$ and $R_2$ is not less than 20.

DETAILED DESCRIPTION OF THE INVENTION

The compound represented by Formula I according to the present invention will be described below.

In Formula I, the aryl group represented by Ar may preferably be a phenyl group having a substituent.

The substituents may preferably include a halogen atom as exemplified by fluorine, chlorine or bromine, an alkyl group as exemplified by methyl, ethyl or butyl, an alkoxyl group as exemplified by methoxy or ethoxy, an aryloxyl group as exemplified by phenoxy or naphthoxy, an acylamino group as exemplified by α-(2,4-di-t-amylphenoxy)butylamido or benzamido, a sulfonylamino group as exemplified by hexadecanesulfonamido or benzenesulfonamido, a sulfamoyl group as exemplified by methylsulfamoyl or phenylsulfamoyl, a carbamoyl group as exemplified by butylcarbamoyl or phenylcarbamoyl, a sulfonyl group as exemplified by methylsulfonyl, dodecylsulfonyl or benzenesulfonyl, an acyloxyl group, an alkoxycarbonyl group, a carboxyl group, a sulfo group, a cyano group and a nitro group.

The group capable of being split off upon reaction with an oxidized product of a color developing agent, represented by Y, may include, for example, a halogen atom such as chlorine, bromine or fluorine, and groups such as alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclic thio, alkyloxythiocarbonylthio, acylamino, sulfonamido, nitrogen-containing heterocyclic ring linked with a nitrogen atom, alkyloxycarbonylamino and aryloxycarbonylamino.

X represents a halogen atom as exemplified by chlorine, bromine or fluorine, an alkoxyl group as exemplified by methoxy, ethoxy or butoxy, or an alkyl group as exemplified by methyl, ethyl, i-propyl, butyl or hexyl. When n is two or more, a plurality of X may be the same or different.

The straight-chain or branched alkyl group having 1 to 20 carbon atoms, represented by R, may include, for example, groups such as methyl, t-butyl t-amyl, t-octyl, nonyl and dodecyl.

The straight-chain or branched alkenylene group represented by J may preferably be a methylene group which may have an alkyl substituent or a trimethylene group which may have an alkyl substituent, more preferably a methylene group, and particularly preferably a methylene group having an alkyl substituent having 1 to 20 carbon atoms as exemplified by a hexylmethylene group, an octylmethylene group or a dodecylmethylene group. Of these, a most preferable group is a methylene group having en alkyl substituent having 1 to 4 carbon atoms as exemplified by a methylmethylene group, an ethylmethylene group, a propylmethylene group, an i-propylmethylene group or a butylmethylene group.

Typical examples of the magenta coupler represented by Formula I are shown below. The present invention is by no means limited by these.

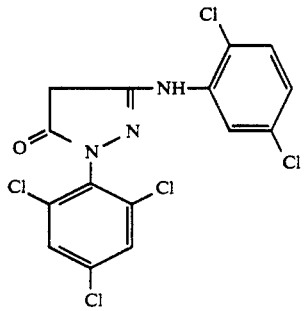

| No. | R |
|---|---|
| M-1 | 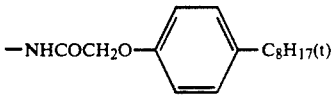  |
| M-2 | 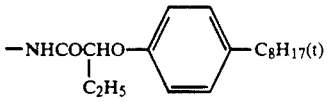  |
| M-3 | 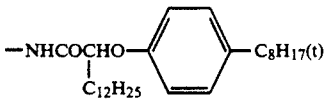  |
| M-4 | 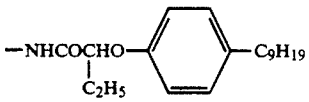  |
| M-5 | 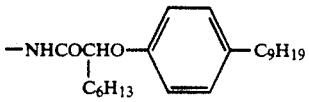  |
| M-6 | 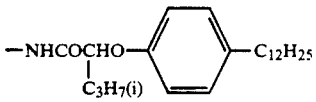  |

-continued
M-7
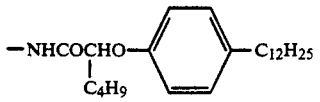
M-8
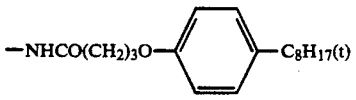
M-9
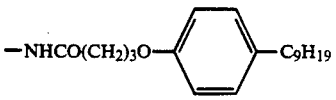
M-10
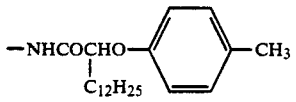
M-11
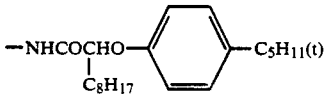
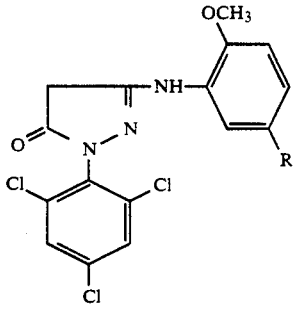
| No. | R |
|---|---|
| M-12 | 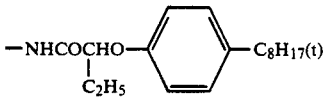 |
| M-13 | 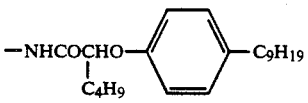 |
| M-14 | 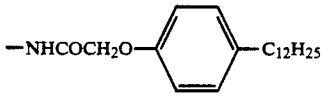 |
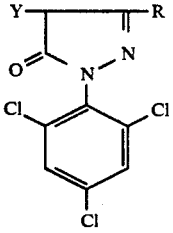
| No. | Y | R |
|---|---|---|

-continued
| | | |
|---|---|---|
| M-15 | H— | 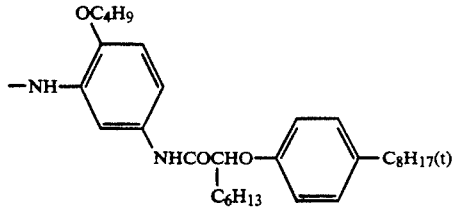 |
| M-16 | 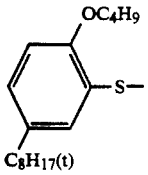 | 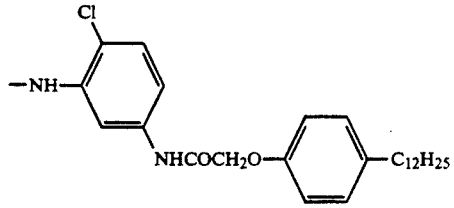 |
| M-17 | H— | 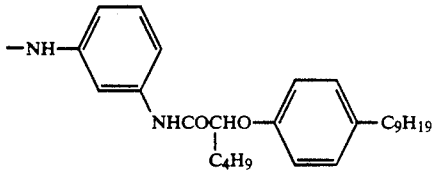 |
| M-18 | 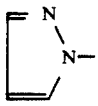 | 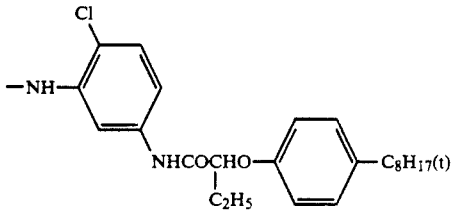 |
| M-19 | H— | 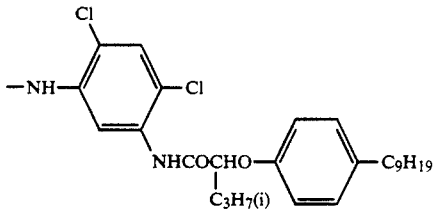 |
| M-20 | 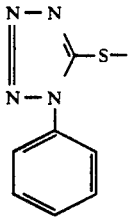 | 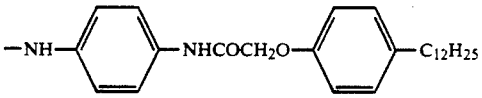 |
| M-21 | 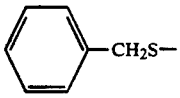 | 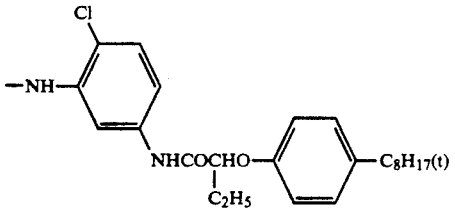 |
| M-22 | $CF_3CONH$— | 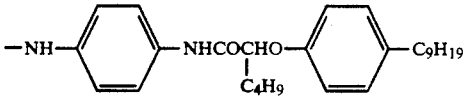 |

-continued
M-23
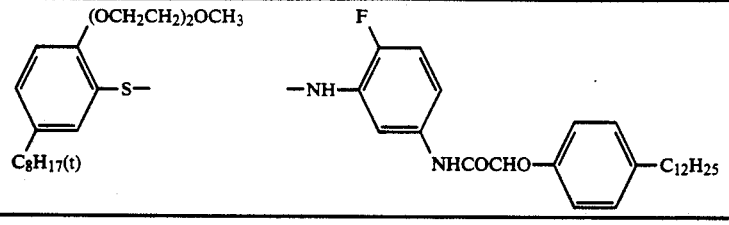
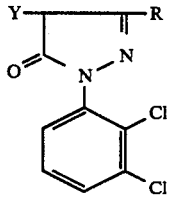
| No. | Y | R |
|---|---|---|
| M-24 | H— | 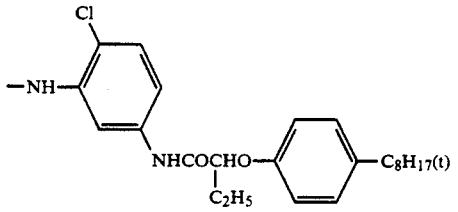 |
| M-25 | 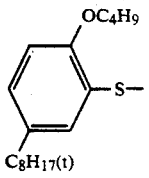 | 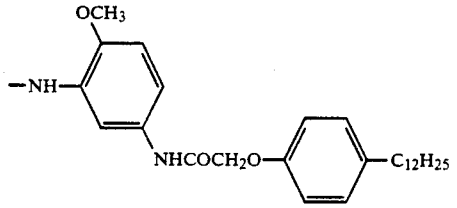 |
| M-26 | H— | 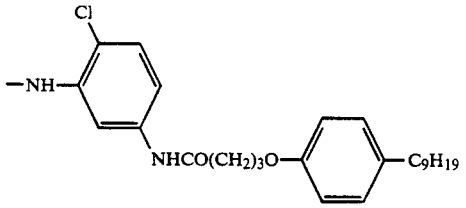 |
| M-27 | 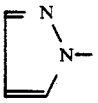 | 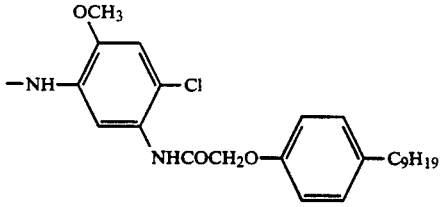 |
| M-28 | H— | 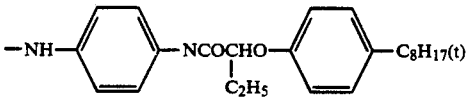 |
| M-29 | $CH_3CO_2$— | 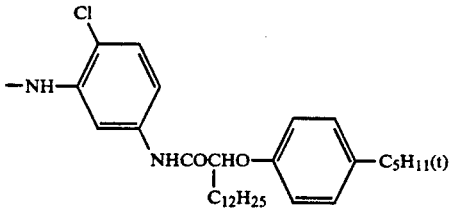 |

-continued

M-30

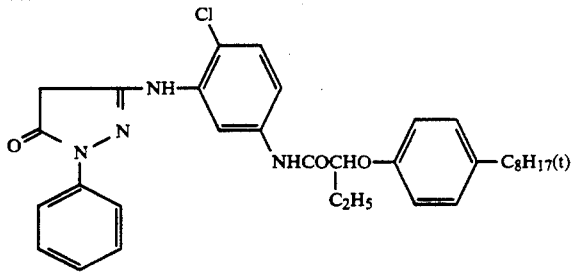

M-31

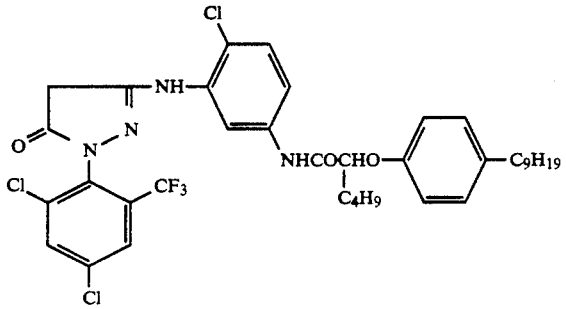

M-32

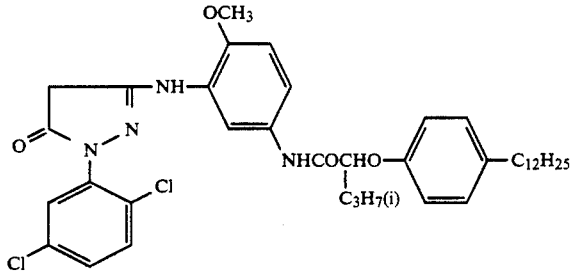

M-33

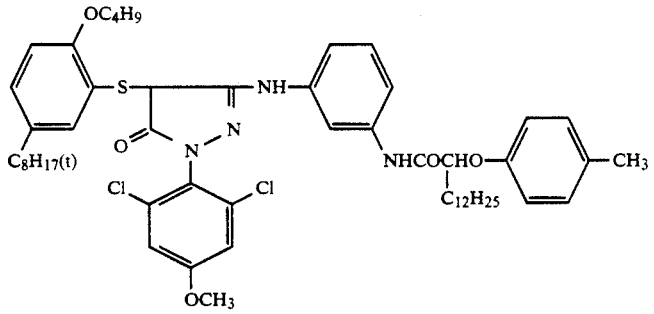

M-34

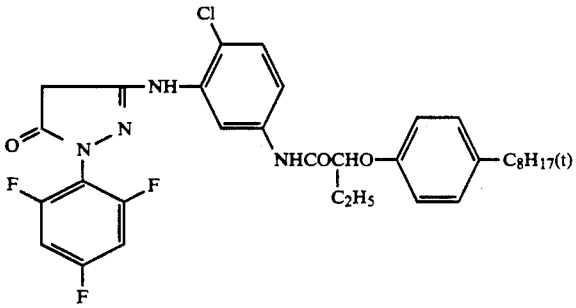

The magenta coupler according to the present invention may be used in an amount ranging usually from $1 \times 10^{-3}$ mol to 1 mol, and preferably from $1 \times 10^{-2}$ mol to $8 \times 10^{-1}$ mol, per mol of silver halide.

The magenta coupler according to the present invention may be used in combination with other magenta coupler(s).

The compound represented by Formula II, an anti-color-mixture agent, used in the present invention will be described below.

$R_1$ and $R_2$ each represent a secondary or tertiary alkyl group, provided that the total sum of carbon atom number of the alkyl groups represented by $R_1$ and $R_2$ is not less than 20.

The alkyl group represented by $R_1$ and $R_2$ may include, for example, groups such as sec-decyl, sec-dodecy, sec-palmityl and sec-eicosyl.

Typical examples of the compound represented by Formula II are shown below. The present invention is by no means limited by these.

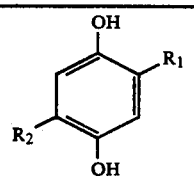

| No. | $R_1$ | $R_2$ |
|---|---|---|
| II-1 | $-C_{10}H_{21}$(sec) | $-C_{10}H_{21}$(sec) |
| II-2 | $-C_{12}H_{25}$(sec) | $-C_{12}H_{25}$(sec) |
| II-3 | $-C_{14}H_{29}$(sec) | $-C_{14}H_{29}$(sec) |
| II-4 | $-C_{12}H_{25}$(sec) | $-C_{14}H_{29}$(sec) |
| II-5 | $-C_{16}H_{33}$(sec) | $-C_{16}H_{33}$(sec) |
| II-6 | $-C_{20}H_{41}$(sec) | $-C_{20}H_{41}$(sec) |
| II-7 | $-C_{30}H_{61}$(sec) | $-C_{30}H_{61}$(sec) |
| II-8 | $-C_{18}H_{37}$(t) | $-C_{18}H_{37}$(t) |
| II-9 | $-C_{15}H_{31}$(sec) | $-C_{15}H_{31}$(sec) |
| II-10 | A reaction product of a mixed $C_{12}$-$C_{14}$ olefin and hydroquinone | |
| II-11 | A reaction product of a mixed $C_{14}$-$C_{16}$ olefin and hydroquinone | |
| II-12 | A reaction product of a mixed $C_{16}$-$C_{18}$ olefin and hydroquinone | |

The compound represented by Formula II is added to a non-sensitive layer, and preferably a non-sensitive layer adjoining to a layer containing the magenta coupler.

Any of these compounds may be added in an amount of usually from 0.01 to 0.5 g/m$^2$ per layer, and may be used alone or in combination with a known anti-stain agent.

There are no particular limitations on the method for preparing and mixing the emulsions having different sensitivities as used in the present invention. For example, silver halide emulsions different in average grain size may be mixed, or silver halide emulsions having the same average grain size may be subjected to different chemical ripening to give different sensitivities.

When two or more kinds of silver halide emulsions are mixed, a high-sensitive emulsion and a low-sensitive emulsion may preferably have a difference in sensitivity of from 0.06 to 0.6 logE, and particularly preferably from 0.10 to 0.51 logE. In the above, E is an exposure amount necessary to form an image having a density of 0.8 after the processing of a sample having a single layer of an emulsion to be tested.

When two kinds of emulsions are mixed, the mixing ratio of the high-sensitive emulsion to the low-sensitive emulsion is preferably 10:90 to 90:10, and more preferably 20:80 to 80:20.

There are no particular limitations on the grain size of the silver halide emulsion according to the present invention. Taking account of rapid processing, sensitivity and other photographic performance, it may preferably be in the range of from 0.2 to 1.6 μm, and more preferably from 0.25 to 1.2 μm.

The grain size can be measured by various methods commonly used in the present technical field. Typical methods are those described in Laveland, "Grain Size Analysis", A.S.T.M. Symposium on Light Microscopy, 1955, pp.94–122; and Mees and James, THE THEORY OF THE PHOTOGRAPHIC PROCESS, Third Edition, Chapter 2, 1966. This grain size can be measured on the basis of projected areas of grains or approximate values of diameters thereof. In instances in which grains have substantially uniform shapes, grain size distribution can be fairly precisely expressed as diameter or projected area.

The distribution of grain size of the silver halide grains according to the present invention may be polydisperse, and may preferably be monodisperse. Preferred are monodisperse silver halide grains preferably having, in the grain size distribution of silver halide grains, a coefficient of its variation of not more than 0.22, and more preferably not more than 0.15. Here, the coefficient of variation is a coefficient that indicates a breadth of grain size distribution, and is expressed as (standard deviation of grain size distribution/average grain size).

The silver halide grains according to the present invention may be of any form. A preferred example is a cube having (100) plane as a crystal face.

Grains having the form of an octahedron, a tetradecahedron or a dodecahedron may be prepared by any methods disclosed in U.S. Pat. Nos. 4,183,756 and 4,225,666. Japanese Patent O.P.I. Publication No. 26589/1980, Japanese Patent Examined Publication No. 42737/1980, and The Journal of Photographic Science (J. Phot. Sci.) 21, 39 (1973). Such grains may also be used. Grains with twin planes or grains with irregular shapes may also be used.

In the color photographic material of the present invention, the silver halide grains contained in the silver halide emulsion layer may be of any composition. They may preferably be composed of silver chlorobromide containing substantially no silver iodide. What is meant by "containing substantially no silver iodide" is that silver iodide is in a content of not more than 1 mol %, and preferably not more than 0.5 mol %. Most preferably no silver iodide should be contained. Silver chlorobromide with a silver chloride content of not less than 90 mol %. and more preferably not less than 99 mol %, or silver chloride can be greatly effective for the present invention. In the present invention, the silver halide grains according to the present invention, containing not less than 90 mol % of silver chloride, for example, silver chlorobromide grains, are preferably chemically sensitized using at least a sulfur sensitizer and a gold sensitizer.

As the sulfur sensitizer, any known compounds can be used. For example, usable sulfur sensitizers can be exemplified by thiosulfates, allylthiocarbamidothiourea. allylisothiocyanates, cystine, p-toluenethiosulfonates and rhodanine. Besides, it is also possible to use sulfur sensitizers as disclosed in U.S. Pat. Nos. 1,574,944, 2,410,689, 2,278,947, 2,728,668, 3,501,313, and 3,656,955, German Patent No. 14 22 869, and Japanese Patent O.P.I. Publication No. 24937/1981 and No. 45016/1980. The sulfur sensitizer may be added in an amount in which the silver halide can be sensitized, and there are no particular limitations on its amount. As a standard, in the case of sodium thiosulfate, it may preferably be contained in an amount of from $1\times10^{-7}$ to $1\times10^{-5}$ mol, and more preferably from $2\times10^{-6}$ to $8\times10^{-6}$ mol, per mol of silver halide.

The gold sensitizer that can be used may include those in which the oxidation number of gold is +1 or +3, and many kinds of gold compounds can be used. As typical examples, they may include chloroauric acid, potassium chloroaurate, aurotrichloride, potassium aurothiocyanate, potassium iodoaurate, tetracyanoauric acid, ammonium aurothiocyanate and pyridyltrichlorogold.

The gold sensitizer is added in an amount which may vary depending on various conditions. It may preferably be added in a concentration of from $5\times10^{-7}$ to $5\times10^{-3}$ mol, more preferably from $2\times10^{-6}$ to $1\times10^{-4}$ mol, still more preferably from $2.6\times10^{-6}$ to $4\times10^{-5}$ mol, and most preferably from $2.6\times10^{-6}$ to $9\times10^{-6}$ mol, per mol of silver halide.

As for the position for addition, the gold compound may be added at any stages in the course of the preparation of silver halide emulsions. It may preferably be added at any time after the silver halide has been formed and until its chemical sensitization is completed.

To silver halide emulsions applied in the color photographic material of the present invention, compounds called antifoggants or stabilizers may be added for the purpose of making the chemical sensitization optimum, or preventing sensitivity from decreasing or fogging from occurring during storage or photographic processing of the light-sensitive material.

A number of heterocyclic compounds or mercapto compounds are known as these compounds, including 4-hydroxy- 6-methyl-1,3,3*a*,7-tetrazaindene, 3-methylbenzothiazole and 1-phenyl-5-mercaptotetrazole, and particularly preferably including purine derivatives or the mercapto compounds as disclosed in Japanese Patent O.P.I. Publications No. 36243/1985, No. 146044/1988 and No. 196035/1989.

The silver halide emulsions according to the present invention can be spectrally sensitized to the desired wavelength region, using dyes known as spectral sensitizer in the photographic industrial field. The spectral sensitizer may be used alone or in combination of two or more kinds. Together with the spectral sensitizer, a dye having no spectrally sensitizing action in itself or a supersensitizer which is a compound capable of absorbing substantially no visible light and increases the sensitizing action of the spectral sensitizer may be contained in the emulsion.

Various dyes can be used as the spectral sensitizer, and the spectral sensitizer may be used alone or in combination of two or more kinds.

In the present invention, advantageously usable spectral sensitizers may include, for example, the following.

Spectral sensitizers used in blue-sensitive silver halide emulsions can be exemplified by those disclosed in German Patent 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent No. 1,242,588, and Japanese Patent Examined Publications No. 14030/1969 and No. 24844/1977. Spectral sensitizers used in green-sensitive silver halide emulsions can be typically exemplified by cyanine dyes, merocyanine dyes or composite cyanine dyes as disclosed in U.S. Pat. Nos. 1,939,201, 2,072,908, 2,739,149 and 2,945,763, and British Patent No. 505,979. Spectral sensitizers used in red-sensitive silver halide emulsions can be typically exemplified by cyanine dyes, merocyanine dyes or complex cyanine dyes as disclosed in U.S. Pat. Nos. 2,269,234, 2,270,378, 2,442,710, 2,454,629 and 2,776,280. Besides, cyanine dyes, merocyanine dyes or complex cyanine dyes as disclosed in U.S. Pat. Nos. 2,213,995, 2,493,748 and 2,519,001 and German Patent No. 929,080 are also advantageously usable in green-sensitive silver halide emulsions or red-sensitive silver halide emulsions.

Any of these spectral sensitizers may be used alone, or may be used in combination. Spectral sensitizers are often used in combination particularly for the purpose of supersensitization. Typical examples of such combination are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377 and 4,026,707, British Patents No. 1,344,281 and No. 1,507,803, Japanese Patent Examined Publications No. 4936/1968 and No. 12375/1978, and Japanese Patent O.P.I. Publications No. 110618/1977 and No. 10992/1977.

There are no particular limitations on the amount of the spectral sensitizers added. In general, each spectral sensitizer may preferably be used in an amount ranging from $1\times10^{-7}$ to $1\times10^{-3}$ mol, and more preferably from $5\times10^{-6}$ to $5\times10^{-4}$ mol, per mol of silver halide.

The spectral sensitizers may be added by the method well known in the present industrial field.

The spectral sensitizers to be contained in the silver halide emulsion of the present invention may be dissolved in solvents of the same type or different types, and these solvent may be mixed before they are added to the silver halide emulsion, or they may be separately added thereto. When separately added, the order, time and intervals of their addition may be arbitrarily set depending on the purpose. The spectral sensitizers may be added to the emulsion at any stages in the course of the preparation of the emulsion. They may preferably be added during chemical ripening or after chemical ripening, and more preferably during chemical ripening.

In light-sensitive color photographic materials, usually a yellow dye forming coupler is used in a blue-sensitive emulsion layer, a magenta dye forming coupler in a green-sensitive emulsion layer, and a cyan dye forming coupler in a red-sensitive emulsion layer Depending on the purpose, a light-sensitive silver halide color photographic material may also be prepared by a method in which the couplers are used in the manner different from the above combination.

These dye forming couplers should each preferably have in the molecule a group having 8 or more carbon atoms, called a ballast group, which is capable of making the coupler non-diffusible. These dye forming couplers may be either of a four-equivalent type wherein four molecules of silver ions must be reduced for the formation of one molecule of the dye, or of a two-equivalent type wherein only two molecules of silver ions may be reduced.

As the yellow dye forming coupler, various acylacetoanilide type couplers can be preferably used. Of these, it is advantageous to use benzoylacetanilide compounds and pivaloylacetanilide compounds.

As the cyan dye forming coupler, naphthol type couplers and phenol type couplers can be preferably used.

The compounds such as dye forming coupler in the light-sensitive material of the present invention may usually be dissolved in a high-boiling organic solvent having a boiling point of 150° C. or above or a water-insoluble polymeric compound. optionally together with a low-boiling and/or water-soluble organic solvent to effect emulsification dispersion in a hydrophilic binder such as an aqueous gelatin solution using a surface active agent, and thereafter the resulting emulsion may be added to the intended hydrophilic colloid layer. The step of removing the low-boiling organic solvent after dispertion or at the same time of dispersion may be inserted.

The high-boiling organic solvent may preferably be a compound having a dielectric constant of not more than 6.5, which is exemplified by esters such as phthalic acid esters and phosphoric acid esters, organic amides, ketones and hydrocarbon compounds, having a dielectric constant of not more than 6.5.

The high-boiling organic solvent may more preferably those having a dielectric constant of not more than 6.5 and not less than 1.9, and a vapor pressure of not more than 0.5 mmHg at 100° C. Of these solvents, phthalic acid esters and phosphoric acid esters are more preferred. Dialkyl phthalates containing an alkyl group having 9 or more carbon atoms are most preferred. The high-boiling organic solvent may also be in the form of a mixture of two or more kinds. The dielectric constant is meant to be a dielectric constant at 30° C.

Any of these high-boiling organic solvents may be used in an amount of usually from 0% by weight to 400% by weight based on the coupler, and preferably from 10% by weight to 100% by weight based on the coupler.

The light-sensitive material of the present invention can be used as, for example, color negative and positive films, and also as color photographic papers or the like. In particular, the present invention can be remarkably effective when used in color photographic papers for direct viewing.

The light-sensitive material including such color photographic papers may be used for either monochromes or multicolor photography.

As a binder used in the color photographic material of the present invention, it is preferred to use gelatin.

The gelatin may be either lime-treated gelatin or acid-treated gelatin, and may be any of gelatins produced using cattle bones, cattle hides, pigskins or the like as starting materials. It may preferably be lime-treated gelatin produced using cattle bones as a starting material.

Photographic emulsion layers and other hydrophilic colloid layers of the light-sensitive material according to the present invention are hardened by cross-linking binder or protective colloid molecules and using alone or in combination a hardening agent or agents for increasing layer strength.

In the light-sensitive material of the present invention, the hydrophilic colloid layers such as a protective layer and an intermediate layer may contain an ultraviolet absorbent so that the light-sensitive material can be prevented from fogging because of electric discharge due to static charging caused by friction or the like or images can be prevented from its deterioration caused by ultraviolet light.

The light-sensitive material of the present invention can be provided with auxiliary layers such as a filter layer, an anti-halation layer and/or an anti-irradiation layer. In these layers and/or in the emulsion layers, a dye may be contained which is flowed out of the light-sensitive material or bleached, during photographic processing.

In the silver halide emulsion layers and/or other hydrophilic colloid layers of the light-sensitive material according to the present invention, a matting agent can be added for the purpose of decreasing the gloss of the light-sensitive material, increasing the retouchability or preventing the mutual sticking of light-sensitive materials.

In the light-sensitive material of the present invention, a lubricant can be added so that the sliding friction can be decreased. An antistatic agent can also be added for the purpose of preventing the light-sensitive material from being electrostatically charged. The antistatic agent may be used in an antistatic layer on the side of a support on which no emulsions are layered, or may be used in the emulsion layers and/or the protective colloid layers other than emulsion layers on the side of a support on which the emulsion layers are provided.

In the light-sensitive material of the present invention, various surface active agents can be used in the photographic emulsion layers and/or other hydrophilic colloid layers for the purposes of improving coating properties, preventing static charge, improving sliding properties, promoting emulsification dispersion, preventing adhesion, and improving photographic performances such as development acceleration, hardening and sensitization.

The photographic emulsion layers and other layers of the light-sensitive material according to the present invention can be formed on every sort of support known in the present industrial field. The support may be either a reflective support or a transparent support. In order to give reflecting properties, a white pigment may be incorporated into the support, or a hydrophilic colloid layer containing a white pigment may be formed on the support. As a reflective support, a paper laminated with white pigment-containing polyethylene, a barita paper, a white polyvinyl chloride sheet, a white polyethylene sheet and a white polyethylene terephthalate sheet may preferably be used.

As the white pigment, an inorganic white pigment and/or an organic white pigment can be used, which may preferably be barium sulfate or titanium oxide.

In the light-sensitive material of the present invention, the support surface may optionally be subjected to corona discharging, ultraviolet irradiation or flame treating and thereafter may be coated with emulsions directly or via an under coat layer, one or more of under coat layer(s) for improving adhesion properties of the support surface, antistatic properties, dimensional stability, friction resistance, hardness, anti-halation properties, friction characteristics and/or other characteristics.

When the silver halide emulsions of the present invention are coated, a thickening agent may be used so that the coating properties can be improved. As for coating methods, extrusion coating and curtain coating are particularly useful which can carry out simultaneous coating for two or more kinds of layers.

In the processing of the light-sensitive material of the present invention, the color developing agent used in the color developing solution may include known agents widely used in various color photographic processes.

Such color developing agents may include aminophenol derivatives and p-phenylenediamine derivatives. Any of these compounds may be used in a concentration of from 0.1 to 30 g per liter of the color developing solution, and more preferably from about 1 to 15 g per liter of the color developing solution.

Particularly useful color developing agents are aromatic primary amine compounds as typified by N,N-dialkyl-p-phenylenediamines. The alkyl group and phenyl group therein may each have any desired substituent. Of these, particularly useful compounds can be exemplified by N,N-diethyl-p-phenylenediamine hydrochloride, N-methyl-p-phenylenediamine hydrochloride, N,N dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline and 4-amino-N-(2-methoxyethyl)-N-ethyl-3-methylaniline p-toluenesulfonate.

To the color developing solution applied in the processing of the light-sensitive material of the present invention, known developing solution component compounds can be added in addition to the aromatic primary amine compound described above.

The color developing solution usually has a pH value of 7 or more, and most commonly from about 10 to 13. Color developing is usually carried out at a temperature of 15° C. or above, and commonly in the range of from 20° C. to 50° C. For rapid developing, the developing may preferably be carried out at 30° C. or above. The color developing may commonly preferably be carried out in a time ranging from 20 seconds to 60 seconds, and more preferably from 30 seconds to 50 seconds.

The light-sensitive material of the present invention may contain in its hydrophilic colloid layer the color developing agent as the agent itself or as a precursor thereof, and may be processed using an alkaline activation bath. Precursors of the color developing agent are disclosed in, for example, U.S. Pat. Nos. 3,342,599, 2,507,114, 2,695,234 and 3,719,492, British Patent No. 803,783, Japanese Patent O.P.I. Publications No. 185628/1975 and No. 79035/1979, and Research Disclosures No. 15159, No. 12146 and No. 13924.

After the color developing, the light-sensitive material of the present invention is usually subjected to bleaching and fixing. The bleaching and fixing may be carried out at the same time.

Many kinds of compound can be used as a bleaching agent, including compounds of polyvalent metals such as iron (III), cobalt (III) and copper (III), in particular, complex salts of any of these polyvalent metal cations with an organic acid, as exemplified by metal complex salts of an aminopolycarboxylic acid such as ethylenediaminetetraacetic acid, nitrilotriacetic acid or N-hydroxyethylenediaminediacetic acid, metal complex salts of malonic acid, tartaric acid, malic acid, diglycolic acid or dithioglycolic acid, or fericyanates and bichromates, any of which may be used alone or in appropriate combination.

As a fixing agent, a soluble complexing agent capable of solubilizing silver halides as complex salts is used. Such a soluble complexing agent may include, for example, sodium thiosulfate, ammonium thiosulfate, potassium thiocyanate, thiourea and thioether.

After the fixing, washing is usually carried out. As a substitute for the washing, stabilizing may be carried out, or the both may be carried out in combination. A stabilizing solution used in the stabilizing may contain a pH adjuster, a chelating agent and an antifungal agent.

As to specific conditions for these processing steps, reference can be made to Japanese Patent O.P.I. publication No. 134636/1983.

EXAMPLES

Preparation of blue-sensitive silver halide emulsion:

In 1,000 ml of an aqueous 2% gelatin solution kept at a temperature of 40° C., the following solution A and solution B were simultaneously added in 30 minutes while controlling the pAg and pH to be 6.5 and 3.0, respectively, and the following solution C and solution D were further simultaneously added in 180 minutes while controlling the pAg and pH to be 7.3 and 5.5, respectively. At this time, the pAg was controlled by the method disclosed in Japanese patent O.P.I. Publication No. 45437/1984 and the pH was controlled using an aqueous solution of sulfuric acid or sodium hydroxide.

| | |
|---|---|
| Solution A: | |
| Sodium chloride | 3.42 g |
| Potassium bromide | 0.03 g |
| By adding water, made up to | 200 ml |
| Solution B: | |
| Silver nitrate | 10 g |
| By adding water, made up to | 200 ml |
| Solution C: | |
| Sodium chloride | 102.7 g |
| Potassium bromide | 1.0 g |
| By adding water, made up to | 600 ml |
| Solution D: | |
| Silver nitrate | 300 g |
| By adding water, made up to | 600 ml |

After completion of the addition, the emulsion was desalted using an aqueous 5% solution of Demol-N, produced by Kao Atlas Co. and an aqueous 20% solution of magnesium sulfate, and then mixed with an aqueous gelatin solution to give a monodisperse cubic emulsion EMP-1 having en average grain size of 0.85 μm, a coefficient of variation of 0.07 and a silver chloride content of 99.5 mol %.

The addition time of the solution C and solution D was changed to give emulsion EMP-2 having an average grain size of 0.75 μm, a coefficient of variation of 0.07 and a silver chloride content of 99.5 mol %.

The emulsion EMP-1 was subjected to chemical ripening at 50° C. for 90 minutes using the following compounds to give a blue-sensitive silver halide emulsion, Em-B-1. The EMP-2 was also subjected to the same chemical ripening to give Em-B-2. Its difference in sensitivity from EM-B-1 was logE 0.30.

| | |
|---|---|
| Sodium thiosulfate | 0.8 mg/mol · AgX |
| Stabilizer STAB-1 | $6 \times 10^{-4}$ mg/mol · AgX |
| Spectral sensitizer BS-1 | $4 \times 10^{-4}$ mg/mol · AgX |
| Spectral sensitizer BS-1 | $1 \times 10^{-4}$ mg/mol · AgX |

Preparation of green-sensitive silver halide emulsion:

The procedure for the preparation of EMP-1 was repeated except that the addition time of the solutions A and B, the addition time of the solutions C and D were changed and 0.15 mg of $K_2IrCl_6$ and 1 mg of $K_4Fe(CN)_6$ were added to the solution C, to give a monodisperse cubic emulsion EMP-3 having an average grain size of 0.43 μm, a coefficient of variation of 0.08 and a silver chloride content of 99.5 mol %.

The emulsion EMP-3 was subjected to chemical ripening at 55° C. for 120 minutes using the following compounds to give a green-sensitive silver halide emulsion (Em-G-1).

| | |
|---|---|
| Sodium thiosulfate | 1.5 mg/mol · AgX |
| Chloroauric acid | 1.0 mg/mol · AgX |
| Stabilizer STAB-1 | $6 \times 10^{-4}$ mg/mol · AgX |
| Spectral sensitizer GS-1 | $4 \times 10^{-4}$ mg/mol · AgX |

The addition time of the solution C and solution was changed to give emulsion EMP-4 having an average grain size of 0.38 μm, a coefficient of variation of 0.07 and a silver chloride content of 99.5 mol %. This was subjected to the same chemical ripening to give Em-G-2.

Difference in sensitivity between Em-G-I and Em-G-2 was logE 0.20.

Preparation of red-sensitive silver halide emulsion:

The procedure for the preparation of EMP-1 was repeated except that the addition time of the solutions A and B, the addition time of the solutions C and D were changed and 0.093 mg of $K_2IrCl_6$ and 1 mg of $K_4Fe(CN)_6$ were added to the solution C, to give a monodisperse cubic emulsion EMP-5 having an average grain size of 0.50 μm, a variation of coefficient of 0.08 and a silver chloride content of 99.5 mol %.

The emulsion EMP-5 was subjected to chemical ripening at 60° C. for 90 minutes using the following compounds to give a red-sensitive silver halide emulsion, Em-R-1.

| | |
|---|---|
| Sodium thiosulfate | 1.8 mg/mol · AgX |
| Chloroaurio acid | 2.0 mg/mol · AgX |
| Stabilizer STAB-1 | $6 \times 10^{-4}$ mg/mol · AgX |
| Spectral sensitizer RS-1 | $1 \times 10^{-4}$ mg/mol · AgX |

The amount of spectral sensitizer RS-1 used in EMP-5, and chemical ripening was carried out to give Em-R-2. Difference in sensitivity between Em-G-1 and Em-G-2 was logE 0.15.

BS-1

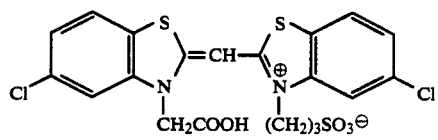

BS-2

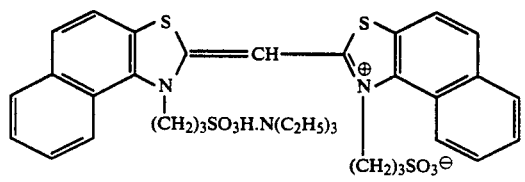

GS-1

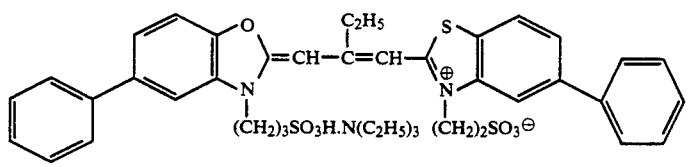

RS-1

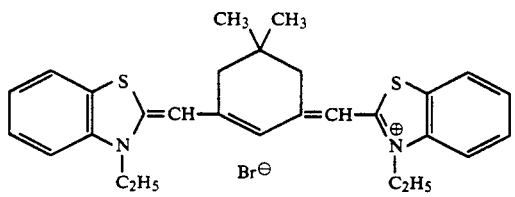

STAB-1

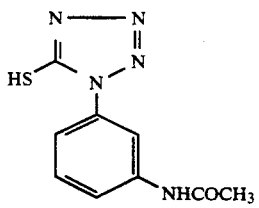

Example 1

On a paper support one side of which was laminated with polyethylene and the other side of which was laminated with polyethylene containing titanium oxide, each layer with the constitution shown in Table 1 was provided by coating on the side on which the polyethylene layer containing titanium oxide was formed, to produce a multi-layer light-sensitive silver halide color photographic material, sample No. 1.

Coating solutions were prepared in the following way:

First-layer coating solution:

To 26.7 g of yellow coupler Y-1, 10.0 g of dye image stabilizer ST-1, 6.67 g of dye image stabilizer ST-2, 0.67 g of an additive AS-1 and 6.67 g of high-boiling organic solvent DNP, 60 ml of ethyl acetate was added to effect dissolution. The resulting solution was emulsifyingly dispersed using a homogenizer, in 220 ml of an aqueous 10% gelatin solution containing 7 ml of a 20% surface active agent SU-1. Thus a yellow coupler dispersion was prepared. This dispersion was mixed with a blue-sensitive silver halide emulsion (silver content: 10 g) prepared under the conditions described later to give a first-layer coating solution.

Second-layer to seventh-layer coating solutions were also prepared in the procedure similar to the first-layer coating solution.

As hardening agents, H-1 was added to the second and fourth layers, and H-2 to the seventh layer. As coating aids, surface active agents SU-2 and SU-3 were added to adjust the surface tension.

TABLE 1

| Layer | Constitution | Amount ($g/m^2$) |
|---|---|---|
| Seventh layer: (protective layer) | Gelatin | 1.00 |
| | Anti-stain agent AS-1 | 0.02 |
| | DIDP | 0.005 |
| | compound F-1 | 0.002 |
| Sixth layer: (Ultraviolet absorbing layer) | Gelatin | 0.40 |
| | Ultraviolet absorbent UV-1 | 0.10 |
| | Ultraviolet absorbent UV-2 | 0.04 |
| | Ultraviolot absorbent UV-3 | 0.16 |
| | Anti-stain agent AS-1 | 0.04 |
| | DNP | 0.20 |
| | PVP | 0.03 |
| | Anti-irradiation dye AI-2 | 0.02 |
| | Anti-irradiation dye AI-4 | 0.01 |
| Fifth layer (Red-sensitive layer) | Gelatin | 1.30 |
| | Red-sensitive silver chlorobromide emulsion Em-R-1 | 0.21 |
| | Cyan coupler C-1 | 0.17 |
| | Cyan coupler C-2 | 0.25 |

TABLE 1-continued

| Layer | Constitution | Amount ($g/m^2$) |
|---|---|---|
| | Dye image stabilizer ST-1 | 0.20 |
| | Anti-stain agent AS-1 | 0.01 |
| | HBS-1 | 0.20 |
| | DOP | 0.20 |
| Fourth layer: (Ultraviolet absorbing layer) | Gelatin | 0.94 |
| | Ultraviolet absorbent UV-1 | 0.28 |
| | Ultraviolet absorbent UV-2 | 0.09 |
| | Ultraviolet absorbent UV-3 | 0.38 |
| | Anti-stain agent AS-1 | 0.10 |
| | DNP | 0.40 |
| Third layer (Green-sensitive layer) | Gelatin | 1.40 |
| | Green-sensitive silver chlorobromide emulsion Em-G | 0.25 |
| | Magenta coupler MS-1 | 0.23 |
| | Dye image stabilizer ST-3 | 0.20 |
| | Dye image stabilizer ST-4 | 0.17 |
| | DIDP | 0.13 |
| | DBP | 0.13 |
| | Anti-irradiation dye AI-1 | 0.01 |
| Second layer: (Intermediate layer) | Gelatin | 1.20 |
| | Anti-stain agent AS-1 | 0.03 |
| | DIDP | 0.06 |
| | Compound F-1 | 0.002 |
| First layer: (Blue-sensitive layer) | Gelatin | 1.20 |
| | Blue-sensitive silver chlorobromide emulsion Em-B-1 | 0.26 |
| | Yellow coupler Y-1 | 0.80 |
| | Dye image stabilizer ST-1 | 0.30 |
| | Dye image stabilizer ST-2 | 0.20 |
| | Anti-staining agent AS-1 | 0.02 |
| | Anti-irradiation die AI-3 | 0.01 |
| | DNP | 0.20 |
| Support: | Polyethylene-laminated paper | |

The amounts of silver halide emulsions added are each indicated in terms of silver weight.

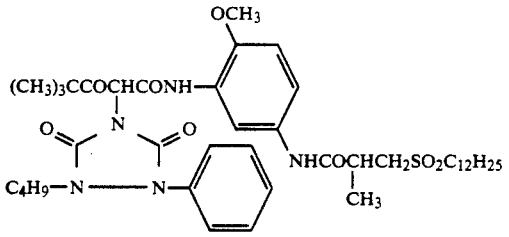

Y-1

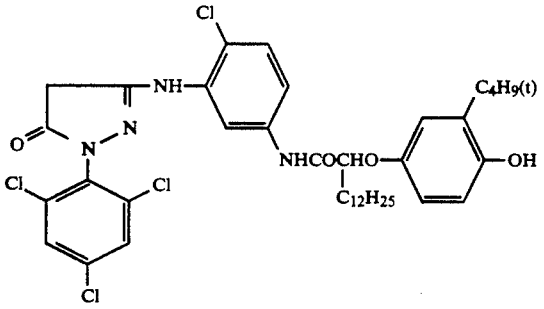

Magenta coupler MS-1

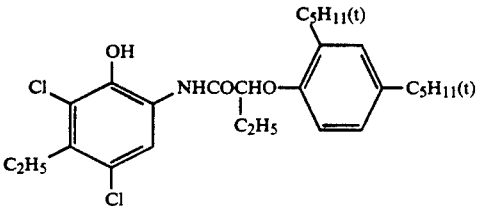

C-1

-continued
C-2
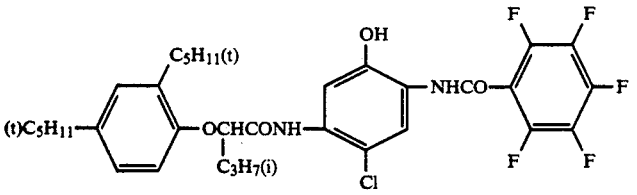
ST-1
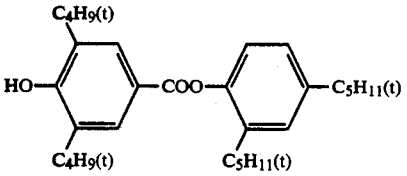
ST-2
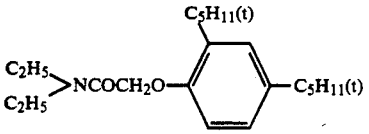
ST-3
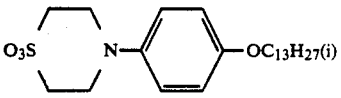
ST-4
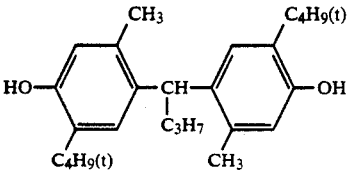
UV-1
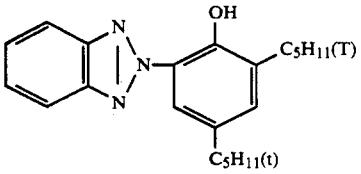
UV-2
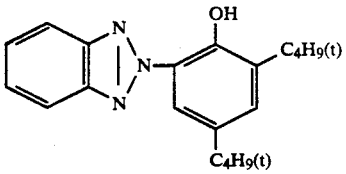
UV-3
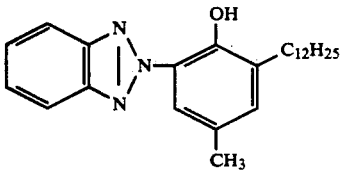
DBP Dibutyl phthalate
DOP Dioctyl phthalate
DNP Dinonyl phthalate
DIDP Diisodecyl phthalate
PVP Polyvinyl pyrrolidone -continued
HBS-1
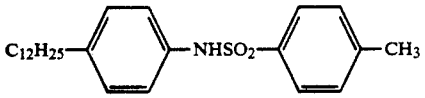
AI-1
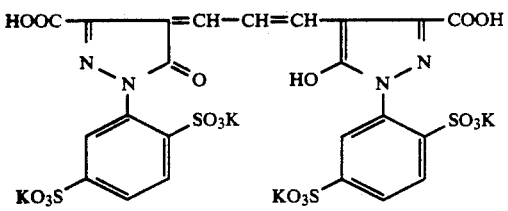
AI-2
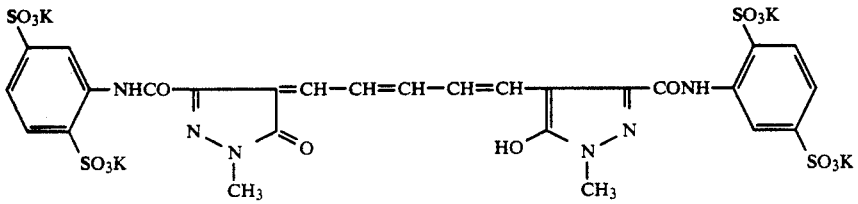
AI-3
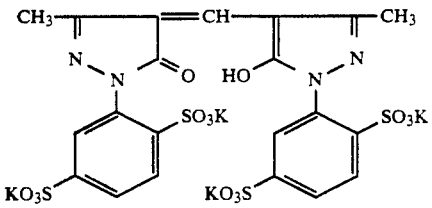
AI-4
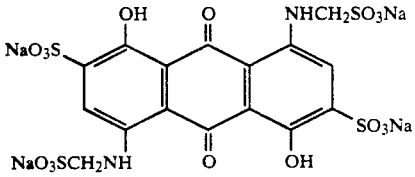
SU-1
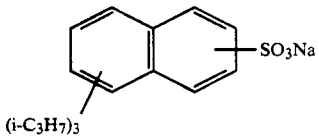
SU-2
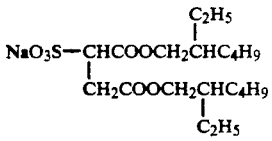
SU-3
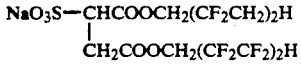
H-1
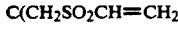
H-2
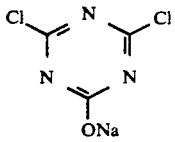

-continued

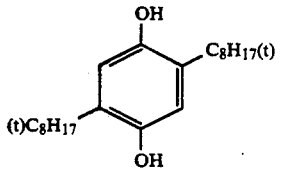

AS-1

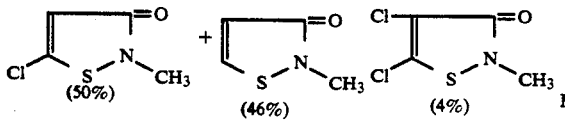

F-1

Molar ratio

The silver halide emulsions in the first, third and fifth layers, the magenta coupler and the anti-stain agent were changed to produce samples 2 to 9 as shown in Table 2.

TABLE 2

| Sample No. | First-layer emulsion | Anti-stain agent: Second layer | Anti-stain agent: Fourth layer | Anti-stain agent: Sixth layer | Emulsion | Magenta coupler | 5th-layer emulsion |
|---|---|---|---|---|---|---|---|
| 1(X) | B-1 | AS-1 | AS-1 | AS-1 | G-1 | MS-1 | R-1 |
| 2(X) | B-1 | II-2 | II-2 | II-2 | G-1 | MS-1 | R-1 |
| 3(X) | B-1 | II-2 | II-2 | II-2 | G-1 | M-2 | R-1 |
| 4(Y) | B-1 | II-2 | II-2 | II-2 | G-1/G-2 | M-2 | R-1 |
| 5(Y) | B-1 | II-2 | II-2 | II-2 | G-1/G-2 | M-5 | R-1 |
| 6(Y) | B-1 | II-2 | II-2 | II-2 | G-1/G-2 | M-13 | R-1 |
| 7(Y) | B-1 | II-2 | II-3 | II-3 | G-1/G-2 | M-2 | R-1 |
| 8(Y) | B-1 | II-2 | II-4 | II-4 | G-1/G-2 | M-2 | R-1 |
| 9(Y) | B-1 | II-2 | II-5 | II-5 | G-1/G-2 | M-2 | R-1 |

X: Comparative Example, Y: Present Invention
G-1/G-2: Mixing ratio of G-1 to G2 as 60:40.

The samples obtained were exposed to tungsten light using a sensitometer OS-1 (manufactured by Konica Corporation), followed by the photographic processing as shown below to make sensitometry. Gradation was evaluated by a slope ($\gamma$) of 1.8 from a reflection density of 0.8. Degree of color mixture was examined by carrying out exposure to blue light (470 nm), green light (550 nm) and red light (670 nm) using an interference filter to form yellow, magenta and cyan images, respectively, followed by the same photographic processing.

On the other hand, a portrait color negative image was printed to each sample with Omega enlarger (manufactured by Konica). The samples were processed and colors of the printed images were visually evaluated.

Results obtained are shown together in Table 3.

| Processing step | Temperature | Time |
|---|---|---|
| Color developing | 35.0 ± 0.3° C. | 45 seconds |
| Bleach-fixing | 35.0 ± 0.5° C. | 45 seconds |
| Stabilizing | 30 to 34° C. | 90 seconds |
| Drying | 60 to 80° C. | 60 seconds |

| Color developing solution | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |
| Ethylenediaminetetraacetic acid | 1.0 g |
| Disodium catechol-3,5-disulfonate | 1.0 g |
| N-ethyl-N-$\beta$-methanesulfonamidoethyl-3-methyl-4-aminoaniline sulfate) | 4.5 g |
| Optical brightening agent (4,4'-diaminostilbenedisulfonic acid derivative) | 1.0 g |

-continued

| | |
|---|---|
| Potassium carbonate | 27 g |

Made up to 1,000 ml in total by adding water, and adjusted to pH 10.10.

| Bleach-fixing solution | |
|---|---|
| Ferric ammonium ethylenediaminetetraacetate dihydrate | 60 g |
| Ethylenediaminetetraacetic acid | 3 g |
| Ammonium thiosulfate (aqueous 70% solution) | 100 ml |
| Ammonium sulfite (aqueous 40% solution) | 27.5 ml |

Made up to 1,000 ml in total by adding water, and adjusted to pH 5.7 with potassium carbonate or glacial acetic acid.

| Stabilizing solution | |
|---|---|
| 5-Chloro-2-ethyl-4-isothiazolin-3-one | 1.0 g |
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (aqueous 20% solution) | 3.0 g |
| Optical brightening agent (4,4'-diaminostilbenedisulfonic acid derivative) | 1.5 g |

Made up to 1,000 ml in total by adding water, and adjusted to pH 7.0 with sulfuric acid or potassium hydroxide.

TABLE 3

| Sample No. | $\gamma$(G) | $(D_G)_Y$ | $(D_B)_M$ | $(D_G)_C$ | Fresh-color reproducibility |
|---|---|---|---|---|---|
| 1(X) | 3.50 | 0.35 | 0.73 | 0.66 | Normal |
| 2(X) | 3.52 | 0.30 | 0.68 | 0.62 | Normal |
| 3(X) | 3.52 | 0.25 | 0.64 | 0.58 | Normal |
| 4(Y) | 2.90 | 0.23 | 0.62 | 0.57 | Excellent |
| 5(Y) | 2.85 | 0.23 | 0.62 | 0.58 | Excellent |
| 6(Y) | 2.88 | 0.24 | 0.63 | 0.58 | Excellent |
| 7(Y) | 2.87 | 0.23 | 0.63 | 0.57 | Excellent |
| 8(Y) | 2.88 | 0.23 | 0.62 | 0.56 | Excellent |
| 9(Y) | 2.90 | 0.24 | 0.62 | 0.57 | Excellent |

X: Comparative Example, Y: Present Invention

In table 3, $(D_G)_Y$ is a density measured by green light of a yellow image having a density of 2.0 measured by blue light, $(D_B)_M$ is a density measured by blue light of a magenta image having a density of 2.0 measured by green light $(D_G)_C$ is a density measured by green light of a cyan image having a density of 2.0 measured by red light. $\gamma$(G) is a $\gamma$ value of the characteristic curve measured by green light.

As is clear from the results shown in Table 3, the samples according to the present invention cause less color mixture, has a soft gradation and has a superior shadow renderability and fresh-color reproducibility With regard to yellow color formed areas of each sample having been processed, the degree of color mixture from the first layer to the third layer is seen from comparison of the degree of green density ($DG_G$) at the point of blue density ($D_B$) of 2.0.

With regard to magenta color formed areas, the degree of color mixture from the third layer to the first layer is also seen from comparison of the degree of blue density ($D_B$) at the point of green density ($D_G$) of 2.0. Similarly, with regard to cyan color formed areas, the degree of color mixture from the fifth layer to the third layer is also seen from comparison of the degree of green density ($D_G$) at the point of red density ($D_R$) of 2.0.

Each density was measured using a PDA-65 type densitometer, manufactured by Konica Corporation. Results obtained are shown together in Table 3.

Example 2

Samples 11 to 19 were produced in the same manner as in Example 1 except that the Em-B-1 in the first-layer blue-sensitive silver halide emulsion layer was replaced with Em-B-2 or combination of Em-B-1 and Em-B-2, an anti-stain agent was used in combination and the fifth-layer emulsion was replaced, all as shown in Table 4.

TABLE 4

| Sample No. | First-layer emulsion | Anti-stain agent: Second layer | Anti-stain agent: Fourth layer | Anti-stain agent: Sixth layer | Third layer: Emulsion | Third layer: Magenta coupler | Fifth-layer emulsion |
|---|---|---|---|---|---|---|---|
| 11(X) | B-2 | AS-1 | AS-1 | AS-1 | G-1 | MS-1 | R-1 |
| 12(X) | B-2 | II-2 | II-2 | II-2 | G-1 | MS-1 | R-1 |
| 13(X) | B-2 | II-2 | II-2 | II-2 | G-1 | M-2 | R-1 |
| 14(Y) | B-1/B-2 | II-2 | II-2 | II-2 | G-1/G-2 | M-2 | R-1 |
| 15(Y) | B-1/B-2 | II-2/AS-1 | II-2 | II-2 | G-1/G-2 | M-2 | R-1 |
| 16(Y) | B-1/B-2 | II-2/AS-1 | II-2/AS-1 | II-2 | G-1/G-2 | M-2 | R-1 |
| 17(Y) | B-1/B-2 | II-2/AS-1 | II-2/AS-1 | II-2/AS-1 | G-1/G-2 | M-2 | R-1 |
| 18(Y) | B-1/B-2 | II-2/AS-1 | II-2/AS-1 | II-2/AS-1 | G-1/G-2 | M-2 | R-1 |
| 19(Y) | B-1/B-2 | II-2 | II-2 | II-2 | G-1/G-2 | M-2 | R-1/R-2 |

X: Comparative Example, Y: Present Invention
B-1/B-2 = 50/50, II-2/AS-1 = 50/50

Samples 11 to 19 were exposed and photographically processed in the same manner as in Example 1 to obtain the results as shown in Table 5.

TABLE 5

| Sample No. | γ(G) | $(D_G)_Y$ | $(D_B)_M$ | $(C_G)_C$ |
|---|---|---|---|---|
| 11(X) | 3.15 | 0.35 | 0.71 | 0.65 |
| 12(X) | 3.17 | 0.31 | 0.67 | 0.61 |
| 13(X) | 3.13 | 0.26 | 0.64 | 0.58 |
| 14(Y) | 2.75 | 0 25 | 0.62 | 0.56 |
| 15(Y) | 2.77 | 0.25 | 0.63 | 0.56 |
| 16(Y) | 2.75 | 0.25 | 0.63 | 0.57 |
| 17(Y) | 2.76 | 0.24 | 0.62 | 0.57 |
| 18(Y) | 2.78 | 0.25 | 0.62 | 0.56 |
| 19(Y) | 2.78 | 0.25 | 0.63 | 0.57 |

X: Comparative Example, Y: Present Invention

As is also clear from Table 5, the samples of the present invention gave the same results as in Example 1 even when the emulsion and anti-stain agent were changed.

As described above, the present invention can provide a color photographic material having a soft gradation, having a superior shadow renderability and causing less color mixture.

What is claimed is:

1. A light-sensitive silver halide color photographic material comprising a support having thereon a blue sensitive silver halide emulsion layer, a green-sensitive silver halide emulsion layer, a red-sensitive silver halide emulsion layer and a non-light-sensitive hydrophilic colloid layer, wherein said green-sensitive silver halide emulsion layer comprises a silver halide emulsion layer and a non-light-sensitive hydrophilic colloid layer, wherein said silver halide emulsion layer comprises a mixture of at least two kinds of silver halide emulsions different insensitivity from each other and contains a magenta dye forming coupler represented by Formula I and said non-light-sensitive layer contains a compound represented by Formula II:

Formula II:

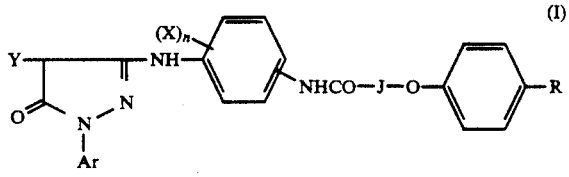

(I)

wherein Ar is an aryl group; Y is a hydrogen atom or a substituent capable of releasing hydrogen upon reaction with the oxidation product of a color developing agent; X is a halogen atom, an alkoxyl group or an alkyl group; n is an integer of 0 to 4, the X's may be the same or different when n is 2 or more; R is a straight chain or branched alkyl group having 1 to 20 carbon atoms, and J is straight or branched chain alkenylene,

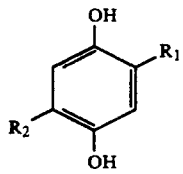

(II)

wherein $R_1$ and $R_2$ are each a secondary or tertiary alkyl group, provided the total number of carbon atoms contained in $R_1$ and $R_2$ is at least 20.

2. The light-sensitive material of claim 1, wherein said magenta coupler contained in said silver halide emulsion layer in an amount of from $1\times10^{-3}$ to 1 mol per mol of silver contained in said silver halide emulsion layer.

3. The light-sensitive material of claim 2, wherein said magenta coupler contained in said silver halide emulsion layer in an amount of from $1\times10^{-2}$ to $8\times10^{-1}$ moles per mol of silver contained in said silver halide emulsion layer.

4. The light-sensitive material of claim 1, wherein a difference in sensitivity between said two kinds of silver halide emulsion is 0.06 to 0.61 in terms of logE, wherein E is an exposure amount necessary to form a density of 0.8.

5. The light-sensitive material of claim 4, wherein difference in sensitivity between said two kinds of silver halide emulsion is 0.10 to 0.51 in terms of logE.

6. The light-sensitive material of claim 1, wherein said silver halide emulsions each comprises silver halide grains having a silver chloride content of not less than 90 mol %.

7. The light-sensitive material of claim 6, wherein said silver halide emulsions each comprises silver halide grains having a silver chloride content of not less than 99 mol %.

8. The light-sensitive material of claim 1, wherein said compound represented by Formula II is contained in said non-light-sensitive layer in an amount of 0.01 g to 0.5 g per square meter.

9. The light-sensitive material of claim 1, wherein said non-light-sensitive material containing said compound represented by Formula II is adjecent to said silver halide emulsion layer.

* * * * *